United States Patent [19]

Maust et al.

[11] 4,181,999

[45] Jan. 8, 1980

[54] SPONGE MOP

[75] Inventors: Daniel C. Maust, Winfield, Ill.; David A. Jones, Dayton, Ohio

[73] Assignee: The Drackett Company, Cincinnati, Ohio

[21] Appl. No.: 928,772

[22] Filed: Aug. 2, 1978

[51] Int. Cl.[2] ..... A47L 13/146

[52] U.S. Cl. ..... 15/119 A

[58] Field of Search ..... 15/116 A, 119 A

[56] References Cited

U.S. PATENT DOCUMENTS

| | | | |
|---|---|---|---|
| 2,044,075 | 6/1936 | Jelenfy | 15/119 A |
| 2,666,939 | 1/1954 | Greenleaf et al. | 15/119 A |
| 2,794,998 | 6/1957 | Watt | 15/119 A |
| 2,869,161 | 1/1959 | Cooper | 15/119 A |
| 3,106,736 | 10/1963 | Knapp | 15/119 A |
| 3,205,520 | 9/1965 | Trentel | 15/119 A |

*Primary Examiner*—Philip R. Coe

*Attorney, Agent, or Firm*—Sharon A. Blinkoff; George A. Mentis; David J. Mugford

[57] ABSTRACT

A sponge mop comprising a base plate secured to a handle, a squeeze plate rotatably attached to a free edge of the base plate, a sponge affixed to the bottom surface of the squeeze plate, and a sponge wringer rotatably attached to the upper surface of the squeeze plate. Rotation of the sponge wringer against the squeeze plate and towards the base plate causes wringing out of the sponge between the plates. The sponge wringer is rotated essentially 360° so that it is adjacent to the mop handle when the sponge is fully wrung out. When the mop is in the mopping position, the handle can be lowered or raised with respect to the surface being mopped, while the sponge remains flush on that surface, by insertion of tabs on the sponge wringer in selected openings provided in the base plate for different handle orientations.

6 Claims, 8 Drawing Figures

SPONGE MOP

BACKGROUND OF THE INVENTION

This invention relates to a sponge mop. Particularly, it relates to a sponge mop having means for facilitating the wringing out of the sponge of the mop and means for adjusting the angle of the mop handle to the surface to be mopped while keeping the mop sponge flush with that surface.

Two problems encountered in sponge mopping are easy wringing out of the mop sponge and mopping under furniture. Generally, with prior art mops the user is put in an uncomfortable position when wringing them out and/or cannot exert adequate leverage to completely squeeze out the water therefrom. Also, to mop under furniture with these mops, the user cannot stand in an upright, normal mopping position but must assume a position lower to the surface being mopped and must also raise a portion of the mop sponge off the surface, which both detract from efficient cleaning.

The sponge mop of the present invention eliminates these problems. This mop has means for the user to select the angle of the mop's handle to the surface being mopped, so that it can be lowered when the user is mopping under furniture and raised otherwise without the mop's sponge having to be placed at an angle to the surface. Second, when this mop is wrung out, the wringing means is rotated almost 360°, which eliminates the uncomfortable position that results with prior art mops wrung out with a 180° rotation of their wringing means.

SUMMARY OF THE INVENTION

In accordance with this invention, a sponge mop is provided which comprises a handle, a base plate secured to the handle, a squeeze plate rotatably attached to the base plate, a sponge affixed to the lower surface of the squeeze plate, and a sponge wringer rotatably attached to the upper surface of the squeeze plate. The sponge wringer is rotated in a selected direction against the squeeze plate to cause rotation of the squeeze plate and sponge against the base plate, thereby causing the sponge to be wrung out. A spring clip and first and second openings are defined in the base plate and two tabs are provided on the sponge wringer. The tabs are insertable into the spring clip and first opening to minimize the angle between the handle and the plane of the cleaning surface of the sponge when the mop is in the mopping position or are insertable into the spring clip and second opening to maximize this angle, whereby the user can lower or raise the mop handle with respect to the surface being mopped as desired.

BRIEF DESCRIPTION OF THE DRAWINGS

The mop of the present invention is best understood from the detailed description below of a preferred embodiment thereof read in conjunction with the drawings herein.

DETAILED DESCRIPTION OF THE INVENTION

Figures 1, 2:
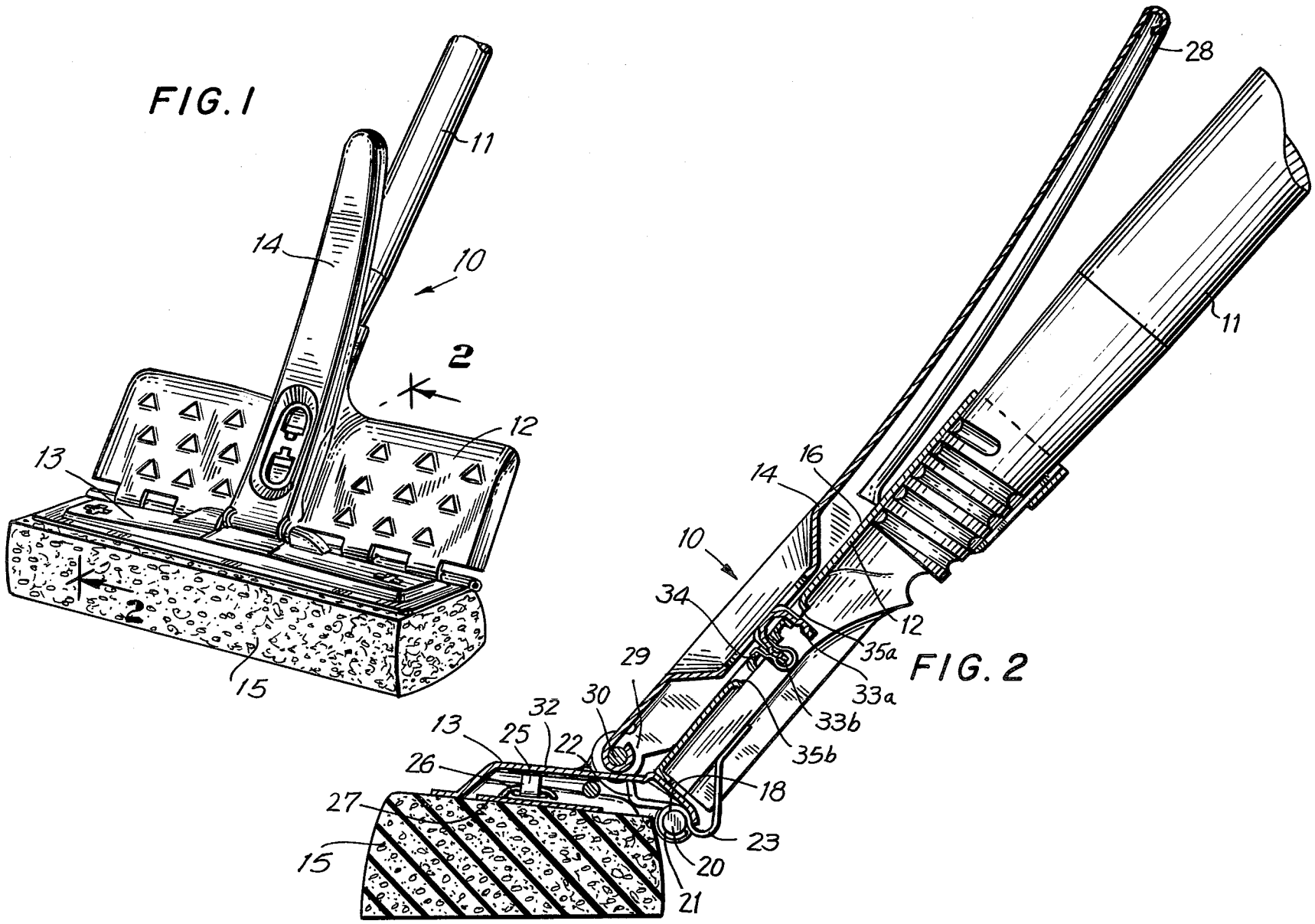
FIG. 1 is a perspective view of a sponge mop of the present invention.
FIG. 2 is a cross-sectional view taken along lines 2—2 of the mop of FIG. 1.

Referring to FIG. 1, there is shown a mop 10, which generally includes a handle 11, a base plate 12, a squeeze plate 13, a sponge wringer 14 and a sponge 15.

Figure 3:
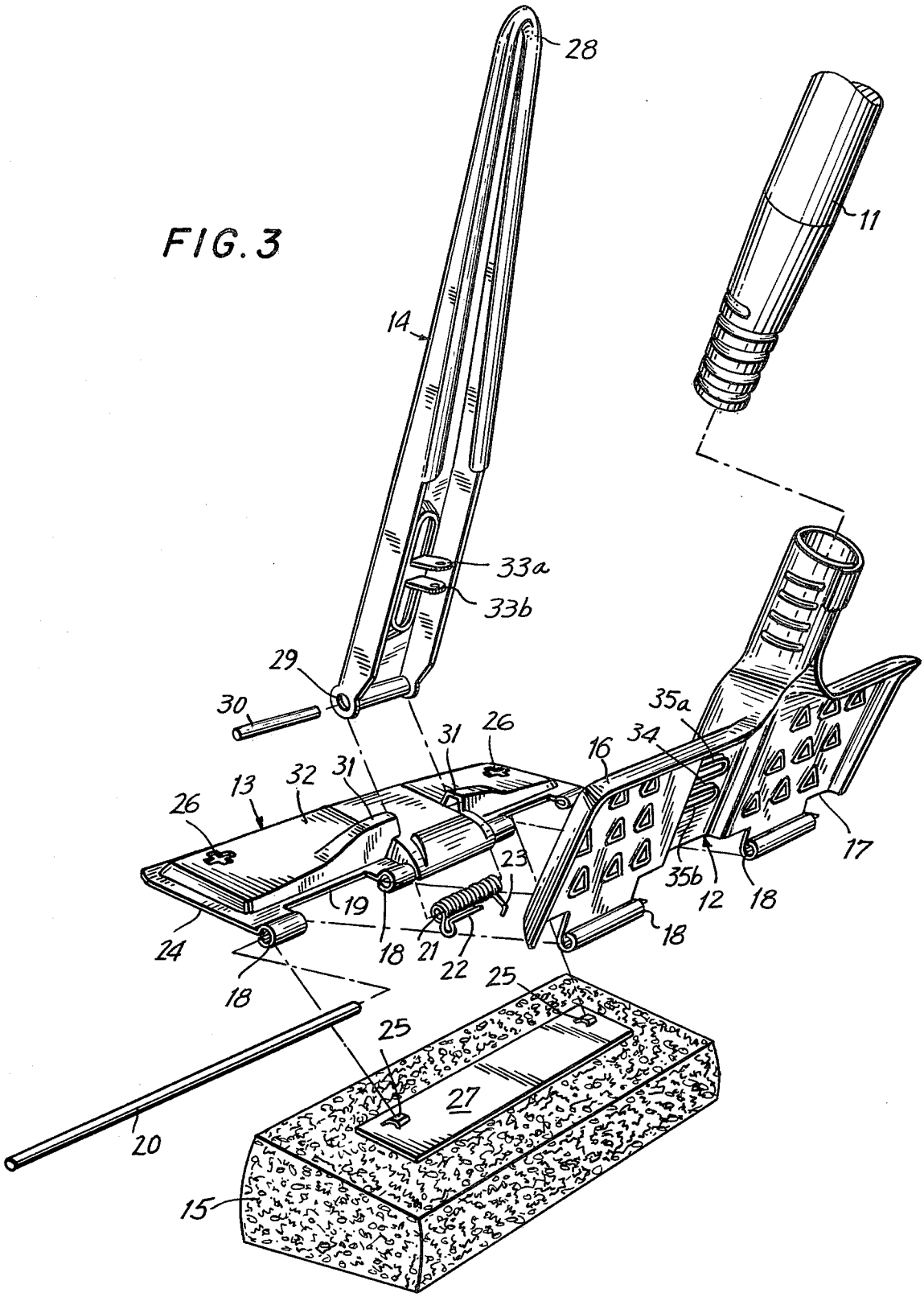
FIG. 3 is a perspective view of the mop of FIG. 1 in its disassembled condition.
Figure 5:
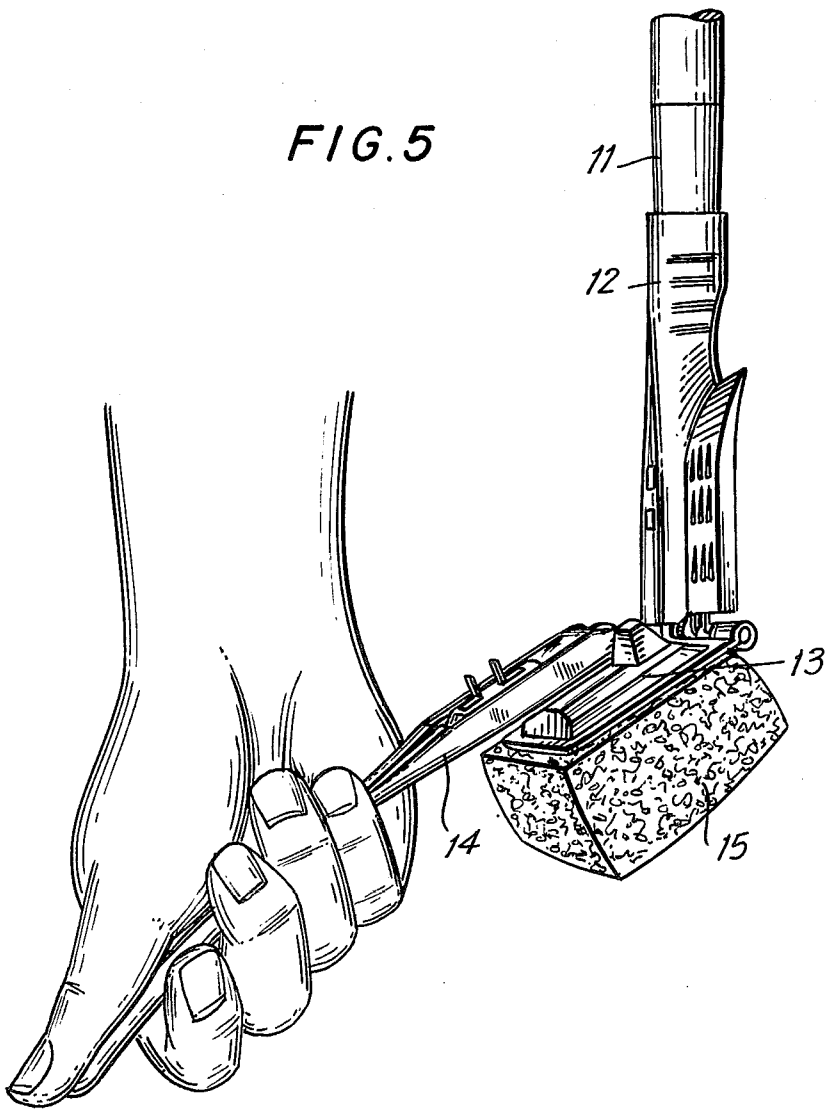
FIGS. 4–8 are perspective views illustrating the operation of wringing out the mop of FIG. 1.

With reference to FIG. 3, the end of handle 11 shown is threaded so as to be insertable into a correspondingly threaded socket formed in the rear edge 16 of base plate 12. The front edge 17 of base plate 12 has formed therein eyelet openings 18 by which squeeze plate 13 can be rotatably attached thereto. similar eyelet openings 18 are formed in the rear edge 19 of squeeze plate 13. A pin 20 extends through the various eyelet openings securing the plates together, but being of such dimensions that squeeze plate 13 can rotate about the pin. A coil spring 21 having end portions 22 and 23 surrounds a segment of pin 20 and normally biases squeeze plate 13 away from the base plate 12 when the mop is in the mopping position shown in FIG. 2. Spring 21 is adapted to be tensioned when sponge 15 is squeezed between the base and squeeze plates, as shown in particularly in FIG. 8.

Joined at the bottom surface 24 of squeeze plate 13 are mating sponge holding means 25 and 26 and a plate 27 to which sponge 15 is secured. Thus, the sponge is situated between squeeze plate 13 and base plate 12 so that it can be wrung out by the operation of sponge wringer 14.

At one end of wringer 14 is a handle portion 28. Defined in its other end is a channel 29. A bar 30 extends through channel 29 and is fixed in openings 31 provided in the upper surface 32 of squeeze plate 13. Wringer 14 is rotatable about bar 30 so that it can be moved against surface 32, thereby causing, by rotation of the wringer essentially 360°, movement of squeeze plate 13 towards base plate 12 and wringing out of sponge 15. Also provided in sponge wringer 14 are two tabs 33 *a* and *b* which protrude towards base plate 12, as best shown in FIG. 2.

Provided in base plate 12 is a spring clip 34, and two openings 35 *a* and *b* surrounding clip 34, which are shown best in FIG. 2. Referring to that drawing, when mop 10 is in the mopping position shown in FIG. 2, the bottom surface of sponge 15 is flush with the surface to be mopped. Handle 11 is at a particular angle to that bottom surface of sponge 15 and the surface to be mopped. Also, tabs 33 *a* and *b* of sponge wringer 14 are inserted in spring clip 34 and opening 35*a* in base plate 12. To keep the bottom surface of sponge 15 in that position while mopping under furniture, sponge wringer 14 is disengaged from base plate 12 and tabs 33 *a* and *b* are inserted into spring clip 34 and opening 35*b*, respectively. Thus, the angle of handle 11 to the surface being mopped is reduced to facilitate mopping and avoid damage by the handle of the furniture.

Figure 4:
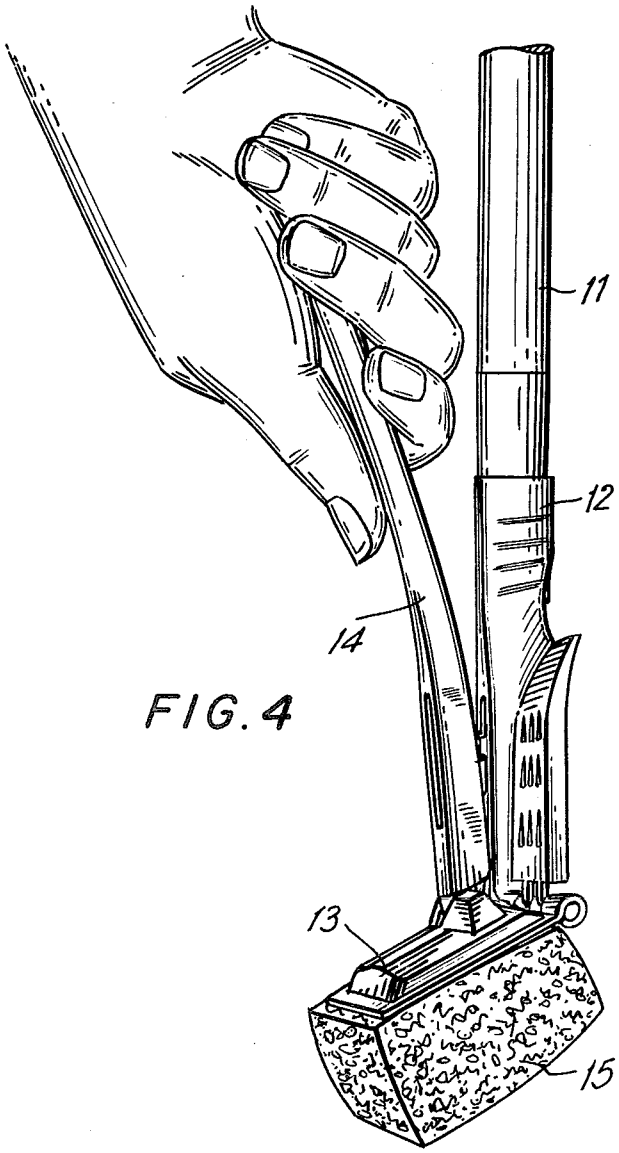
Figure 8:
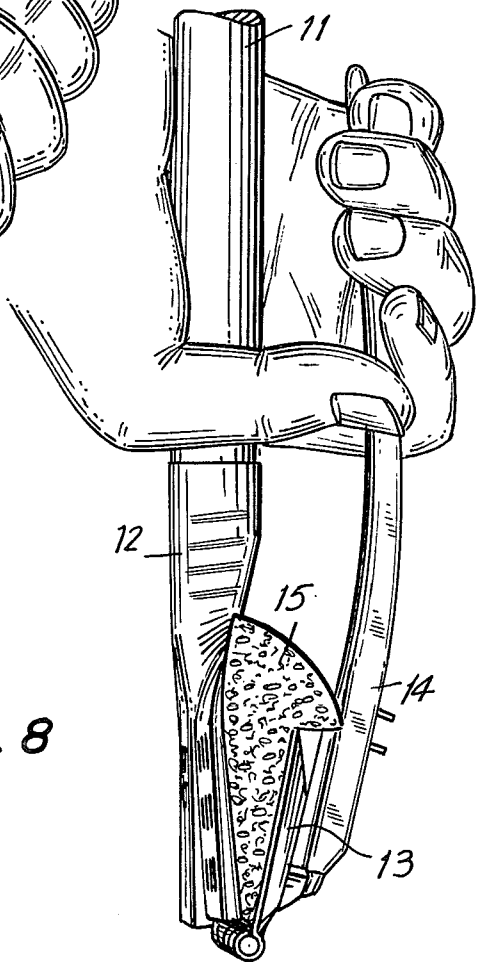
Figure 7:
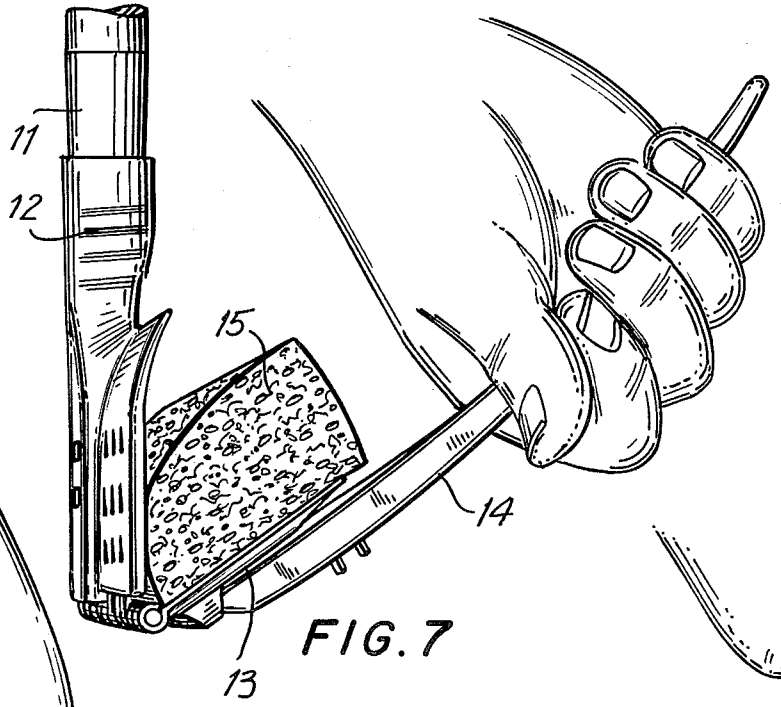
Figure 6:
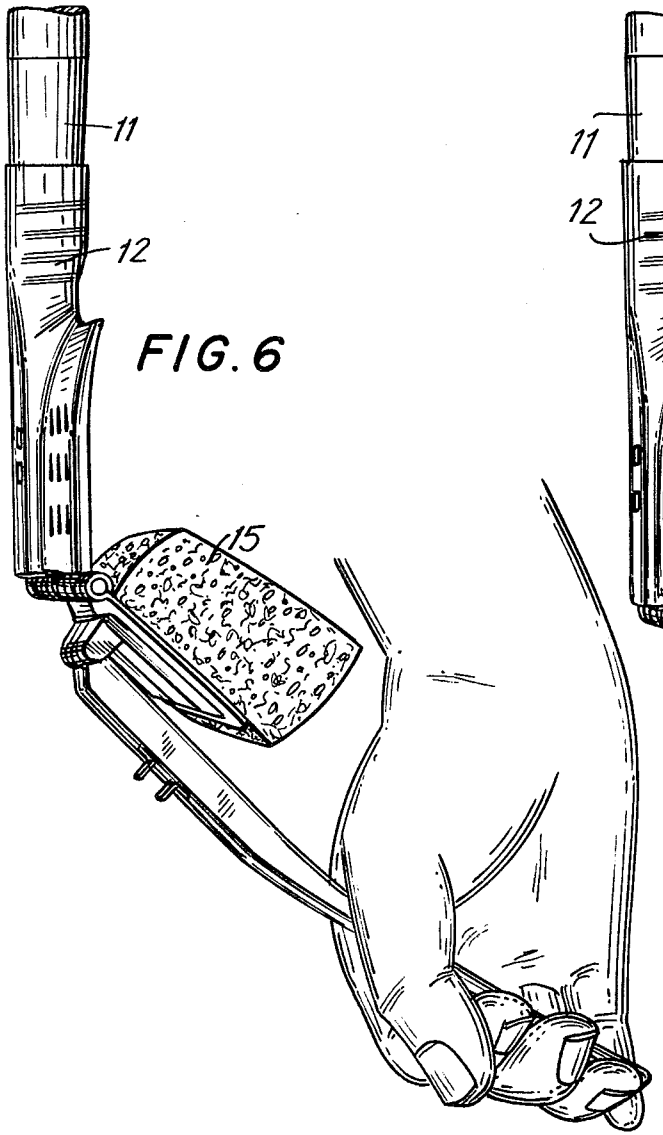

To wring out mop 10, the wringing operation shown in FIGS. 4–8 is performed. As shown in FIG. 4, at least a portion of sponge wringer 14 is adjacent one side of the handle 11 prior to the sponge wringing operation. Proceeding through the operation shown in FIGS. 4–8, the sponge wringer is rotated approximately 360° to fully wring out sponge 15, whereby at least a portion of sponge wringer is adjacent the other side of the handle 11. The sponge wringer is oriented adjacent to the handle and not away from the handle as is the case with the prior art mop mentioned above after their sponges have been wrung out. Thus, with the mop of the present invention, the user is not only put in a more comfortable position during the sponge wringing operation but may also wring out sponge 15 with one hand, as shown in FIG. 8.

What is claimed is:

1. A sponge mop comprising:

a handle;

a base plate having connecting means to rigidly secure the base plate to the handle;

a squeeze plate rotatably attached to the base plate;

a sponge affixed to the lowest surface of the squeeze plate;

a sponge wringer rotatably attached to the upper surface of the squeeze plate; and means for selecting the angle of the handle to the plane of the cleaning surface of the sponge, wherein the means comprises a spring clip and first and second openings defined in the base plate and two tabs on the sponge wringer, the tabs being insertable respectively into the spring clip and first opening to minimize the angle and being insertable respectively into the spring clip and second opening to maximize the angle, thereby allowing the user to lower or raise the mop handle with respect to the surface being mopped.

2. The mop of claim 1 wherein the connecting means comprises a socket with threads defined in the rear edge of the base plate, and threads on the handle, the threads on the handle being adapted to engage the threads of the socket to rigidly connect the handle to the base plate.

3. The mop of claim 1 wherein at least one eyelet opening is defined in the front edge of the base plate, at least one eyelet opening is defined in the rear edge of the squeeze plate, and a pin extends through the eyelet openings, the squeeze plate being rotatable about the pin towards the base plate.

4. The mop of claim 3 further comprises a coil spring biasing the squeeze plate away from the base plate when the mop is in the mopping position and adapted to be tensioned when the sponge is squeezed between the base and squeeze plates, the spring surrounding a segment of the pin and having an end portion in contact with each of the base and squeeze plates.

5. The mop of claims 1 further comprising openings defined in the upper surface of the squeeze plate, a bar fixed in the squeeze plate openings, and a channel in the sponge wringer through which the bar extends, the sponge wringer being rotatable about the bar against the upper surface of the squeeze plate for rotation of the squeeze plate towards the base plate.

6. The mop of claim 1 wherein a least a portion of the sponge wringer is adjacent to the handle when the mop is in the mopping position and when the sponge is fully wrung out between the base and squeeze plates.

* * * * *